United States Patent [19]

Walley, Jr.

[11] 4,080,654

[45] Mar. 21, 1978

[54] VEHICLE PERFORMANCE MONITOR

[75] Inventor: Everette Dewitt Walley, Jr., North Chili, N.Y.

[73] Assignee: General Signal Corporation, Rochester, N.Y.

[21] Appl. No.: 670,283

[22] Filed: Mar. 25, 1976

[51] Int. Cl.[2] ..... G06G 7/70

[52] U.S. Cl. ..... 364/426; 340/62; 364/551; 364/805

[58] Field of Search ..... 235/150.2; 340/53, 62, 340/263

[56] References Cited

U.S. PATENT DOCUMENTS 3,985,396 10/1976 Kuwana et al. ..... 235/150.2 X

*Primary Examiner*—Felix D. Gruber

*Attorney, Agent, or Firm*—Pollock, Vande Sande & Priddy

[57] ABSTRACT

A vehicle performance monitor includes a simulator which responds to the same control signals as does the vehicle control system and, produces at its output, a signal against which actual vehicle performance can be measured. This signal and another signal, generated by the vehicle control system, indicative of vehicle performance are compared, by a comparator in the vehicle performance monitor, to determine if the vehicle is properly responding to the control signals.

The simulator may comprise a function generator which accepts the control signals and transforms them in a form so as to control a voltage controlled oscillator (VCO). The VCO produces an output signal which can be compared with the output of a vehicle mounted device producing a signal related to the actual vehicle performance. For instance, the function generator may produce a signal related to expected vehicle velocity and the vehicle mounted device may be a tachometer. The comparator includes a modulator and a band pass filter. Energy will pass the filter only if the vehicle is proceeding at the command speed or within allowable tolerances thereof.

Although double side band amplitude modulation may be employed, particular advantages are obtained employing single band modulation. In particular, the single side band modulation provides a constant tolerance band independent of vehicle velocity and also provides vehicle direction information.

17 Claims, 19 Drawing Figures

FIG. 4.
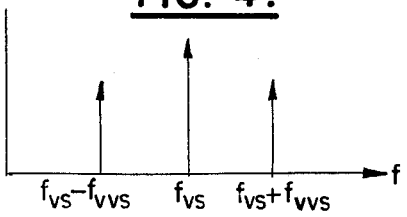
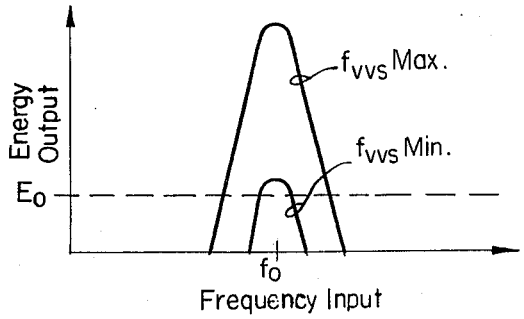
FIG. 5.
Band Pass Filter Transfer Function
FIG. 6.
Relationship Between BPF And Summer Output
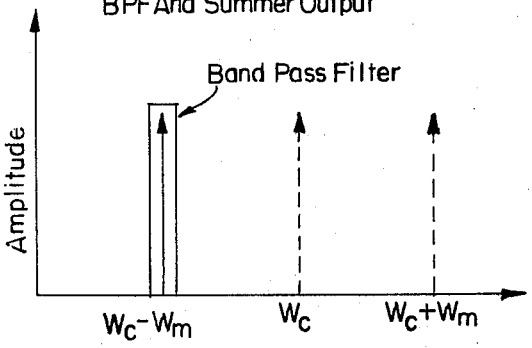
FIG. 7.
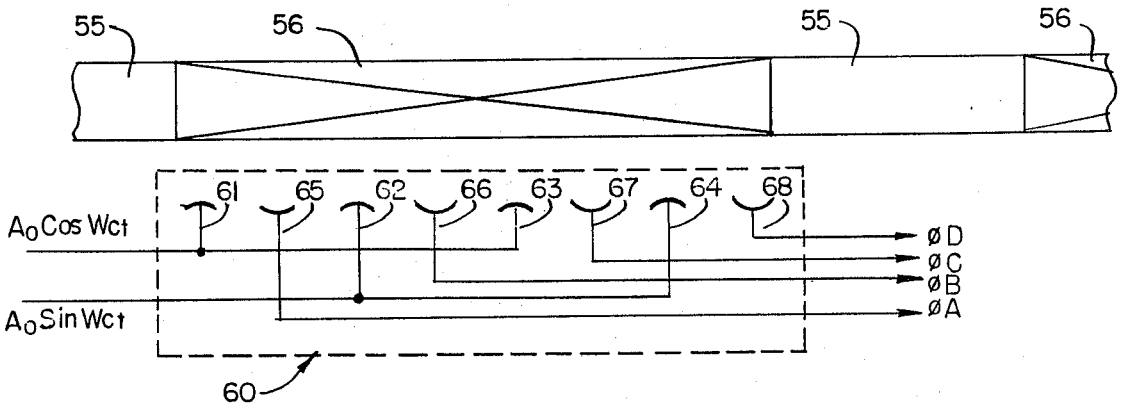

Input A, Output V Of Function Generator Without Test Function

Input A, Output V Of Function Generator With Test Function

VEHICLE PERFORMANCE MONITOR

FIELD OF THE INVENTION

The present invention is useful in vehicle control systems to determine whether or not the vehicle is properly responding to control signals transmitted to the vehicle.

BACKGROUND OF THE INVENTION

In the prior art of automatically and semi-automatically controlled vehicles apparatus has been provided to determine whether or not the vehicles performance has exceeded some commanded criteria. For instance, it is quite common, in vehicle control systems, to employ a vehicle speed governor which prevents the vehicle from reaching speeds above a particular speed limit. In particular, in the field of automatically controlled railroad vehicles a frequency responsive governor is illustrated in the prior art. This governor has applied to it control signals which are communicated to the vehicle, to define the vehicle's speed limit. In addition, the frequency responsive governor also receives a signal from a vehicle mounted tachometer or the like which signal has a frequency proportional to vehicle speed. The frequency responsive governor then is capable of determining whether or not the vehicle is exceeding a commanded speed limit. A typical example of such a frequency responsive governor is found in Butler et al U.S. Pat. No. 3,886,420.

Of course, vehicle speed limits are an important consideration in preserving the safe operation of the vehicle and the passengers and/or cargo carried by a vehicle. However, vehicle speed is also indicative of efficient operation of the transportation system of which the vehicle is but a part. Thus, for instance, if the vehicle is significantly under speed, that is, it is proceeding at a speed substantially below the speed limit, then while the system may be operating safely, it is certainly not operating efficiently. More important is the fact that if it were possible, in a fail-safe manner, to determine that the vehicle was proceeding within reasonable tolerance of commanded speed, it would be possible to accurately, and safely, predict vehicle position. With present day apparatus this is not possible since so long as the vehicle is in motion and below maximum speed limit it is considered operating properly. Obviously, under these conditions prediction of vehicle position is not possible with any reasonable degree of precision.

The foregoing is but one example of the need in the automatic transportation field for a vital universal performance monitor. The ultimate use of this would be to monitor vehicle performance and guarantee that the performance is within safe and efficient limits, i.e., both upper and lower limits.

It is therefore one object of the present invention to provide a vehicle performance monitor for determining, in a vital fashion, whether or not a vehicle is performing within acceptable bounds. It is another object of the present invention to provide such a vehicle performance monitor which is responsive to the same control signals which control vehicle speed. It is still another object of the present invention to provide a vehicle performance monitor as aforementioned which produces a signal indicative of expected vehicle performance which signal can be compared with a signal indicative of actual vehicle performance to determine whether or not the vehicle is performing properly in light of the received controlled signals.

SUMMARY OF THE INVENTION

The present invention meets these and other objects by providing a vehicle performance monitor including a simulator and a comparator. The simulator is provided to, in effect, simulate the performance of the vehicle. This apparatus, acting in concert with known varieties of vehicle control systems can then determine whether or not the vehicle is performing within predetermined limits. The simulator can comprise a function generator which is responsive to vehicle control signals communicated to the vehicle to generate a signal capable of controlling a voltage controlled oscillator. The voltage controlled oscillator produces a signal which is indicative of expected vehicle performance. The comparator portion of the vehicle performance monitor then enables a comparison to be effected between the signal indicative of actual vehicle performance and the signal indicative of expected vehicle performance. If the vehicle is performing within the predetermined limits the output of the comparator then distinctively conditions a detector to indicate this fact. On the other hand, if the vehicle is not operating within the predetermined limits the condition of the detector distinctively indicates this condition.

The comparator portion of the vehicle performance monitor includes a modulator for mixing the signals indicative of actual and expected vehicle performance, and a band pass filter which passes significant energy only when the vehicle is operating within the aforementioned predetermined limits.

In one preferred embodiment of the invention the modulator can perform double side band amplitude modulation function. In another preferred embodiment of the invention the modulator can be a single side band modulator. This latter form of modulation provides significant advantages in that it establishes a fixed velocity tolerance (rather than a percentage tolerance) and furthermore may provide information indicative of vehicle direction.

BRIEF DESCRIPTION OF THE DRAWINGS

Several preferred embodiments of the invention will now be described in this specification when taken in conjunction with the attached drawings in which:

FIG. 4 is a frequency spectrum employed in describing the characteristics of the present invention;

FIG. 5 is a plot of energy output versus frequency for a band pass filter employed with one preferred embodiment of the invention;

FIG. 6 is a frequency spectrum of various signals in the preferred embodiment of the invention illustrating particularly the band pass filter characteristic;

FIG. 7 is a schematic illustration of the tachometer/-modulator 32;

DETAILED DESCRIPTION OF PREFERRED EMBODIMENTS

Typically, the controlled variable in a vehicle control system is vehicle velocity. Actually, other movement related variables could be used as well, such as distance, acceleration, etc. The present invention will be disclosed in the context of a velocity controlling system although those skilled in the art will understand that it can be applied to system employing controlled variables other than velocity.

Figure 1:
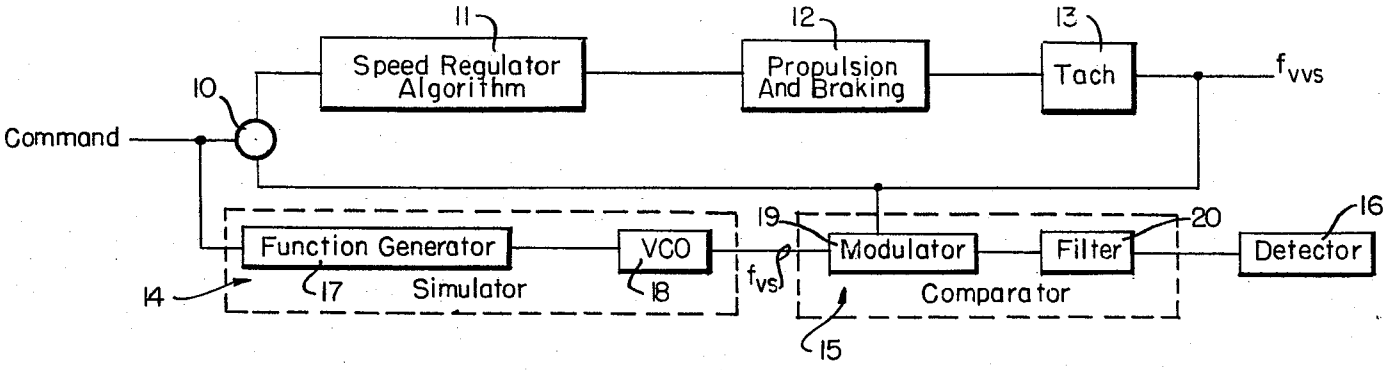
FIG. 1 is a block diagram of a preferred embodiment of the invention.

FIG. 1 illustrates a block diagram of the inventive apparatus cooperating with a prior art variety of vehicle control systems. The known vehicle control system is represented by summer 10, speed regulator algorithm 11, propulsion and braking apparatus 12 and tachometer 13. This apparatus is illustrated, in FIG. 1, in the well known servo-loop for controlling vehicle speed as a function of commands provided to the summer 10. In practical application, the command is normally communicated to the vehicle from the wayside and vehicle carried components may perform known functions of reception, demodulation, demultiplexing and the like upon the received signals before they are provided to the summer 10. Detailed description of the apparatus to perform these functions, and the necessity for the functions are not believed necessary as they are well known to those skilled in the art. As is also well known to those skilled in the art the tachometer 13 produces a signal whose frequency is proportional to actual vehicle speed. This signal is represented in in FIG. 1 as $f_{vvs}$.

The inventive apparatus is responsive to this signal as well as to the command signal provided to the summer 10. The inventive apparatus includes simulator 14 which receives the same command signal which is provided to the summer 10 and which provides an output to a comparator 15. The output of comparator 15 is provided to a detector 16. The function of detector 16 can be performed by a relay or the like device which is capable of assuming two distinct states in response to energy supplied thereto.

More particularly, the simulator 14 can comprise a function generator 17 and a voltage controlled oscillator 18. The purpose of the simulator 14 is to provide a signal $f_{vs}$ to comparator 15.

This signal ($f_{vs}$) is derived from information communication by the command has a parameter which is proportional to the expected velocity of the vehicle as a consequence of the command. The function generator actually performs two distinct functions. The first can be considered a code conversion in that it converts the command (in whatever form received) to a voltage for controlling the VCO. This is a mere translation function determined solely by the code used to transmit commands. The second function is to actually simulate vehicle performance. That is, with what lag, for instance, does the vehicle respond to a change in command. This is the simulation function which must be matched to the vehicle's characteristics. Generally, the vehicle speed control system (speed regulator algorithm 11 — See FIG. 1) imposes an acceleration limit. Therefore, the lag function can be implemented in an analog system by a capacitative impedance. In digital systems this is implemented by proper timing. The construction of a voltage controlled oscillator is well known to those skilled in the art and therefore detailed discussion thereof need not be provided herein. Furthermore, the function of function generator 17 is to receive the command signal and convert the form of that signal to a voltage which will properly control the voltage controlled oscillator 18. Of course, the specific configuration of the function generator 17 depends, in part, on the format of the command signals communicated to it. For instance, if the command were in the form of a signal whose frequency was proportional to a speed command, the function generator could be a frequency-voltage converter with the aforementioned lag factor. On the other hand, if the command were in the form of a digital code, the function generator would have to decode the signal to determine the commanded speed, implement the lag and provide a voltage generator to provide a voltage proportional to such speed to the VCO. Alternatively, the command could be an acceleration signal commanding a specified amount of acceleration. Thus, the function generator would require an integrator to produce a velocity related signal with the appropriate lag, and then a voltage generator which derives a voltage related to that velocity for driving the VCO. One typical function generator is disclosed in connection with FIGS. 8A and 8B.

Comparator 15 comprises a modulator 19 serially connected to a band pass filter 20. The VCO output, $f_{vs}$ is provided as one input to modulator 19 and the output of tachometer 13, $f_{vvs}$, is provided as the other input to the modulator 19. The output of the modulator is a signal whose frequency spectrum is representative of the difference between the two input frequencies. Band pass filter 20 has a fixed frequency response.

Figure 2:
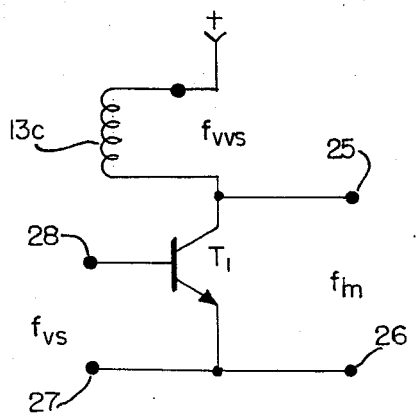
FIG. 2 is a schematic diagram of a modulator that can be employed.

FIG. 2 illustrates a typical amplitude modulator which could be employed as modulator 19. In particular, a positive voltage supply, + is connected to the coil 13c of tachometer 13. The other terminal of coil 13c is connected to an output terminal 25 and also to the collector of a transistor T1. The emitter of transistor T1 is connected to terminals 26 and 27. The output of VCO 18 is connected between a terminal 28, connected to the base of transistor T1, and a terminal 27. The output of the modulator, $A_m(t)$ is available between terminals 25 and 26. This output, for the modulator illustrated in FIG. 2, takes the form:

$$A_m(t) = A_{vs}\cos 2\pi f_{vs}t + (A_{vs}A_{vvs}/2)\cos(2\pi f_{vs} - 2\pi f_{vvs})t + (A_{vs}A_{vvs}/2)\cos(2\pi f_{vs} + 2\pi f_{vvs})t$$

In the foregoing expression $A_m$ is the amplitude of the modulator output, $A_{vs}$ is the amplitude of the VCO output, $A_{vvs}$ is the amplitude of the output from tachometer 13. For a typical tachometer the amplitude of the output signal is proportional to the frequency of the output signal. Thus, the frequency content of the modulator output can be thought of as a carrier frequency $f_{vs}$ with side bands at the sum and difference frequencies $f_{vs} \pm f_{vvs}$. (In this regard, see FIG. 4). The pass band of the filter is selected to pass the difference frequency when, and only when, the vehicle is operating within predetermined limits. The center frequency of the band pass filter is selected to be the frequency of the VCO output when the speed command is zero.

FIG. 5 is a plot of energy output of band pass filter 20 as opposed to the input frequency and wherein $f_o$ is the center frequency of the pass band. The upper curve relates energy output of the filter at maximum $f_{vvs}$ for differing modulator output amplitudes. Similarly, the lower curve in this Figure illustrates energy output of the band pass filter at the minimum acceptable $f_{vvs}$, also for different modulator output amplitudes. The horizontal thereshold $E_o$ is the minimum energy required to actuate the detector 16. The effect of having the modulator output amplitude as a function of input frequency $f_{vs}$ is to have the performance tolerance commensurate with commanded velocity.

That is, at low velocities the modulator output amplitude is relatively low. Since the detector 16 requires a fixed energy output of the filter the low input to the filter (at low velocities) means the tolerance band of the filter and detector is narrower than at higher velocities. This is true notwithstanding the fixed nature of the filter and comes about since the modulator output amplitude is a function of frequency. Thus, at low velocities the tolerance band is smaller (in absolute terms) than at higher velocities.

Figure 3:
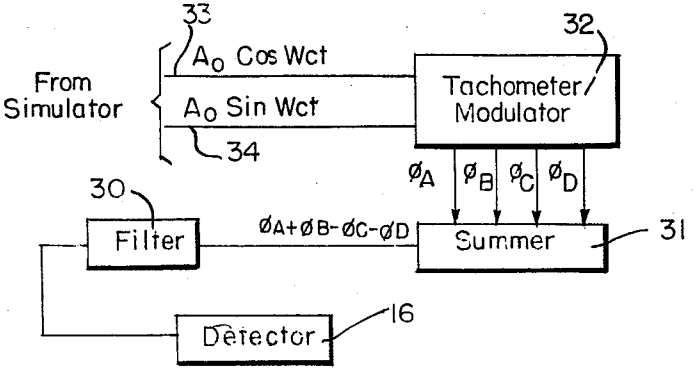
FIG. 3 is a block diagram of a portion of a second preferred embodiment of the invention relying on a single side band modulation.

Another preferred embodiment of the invention is illustrated in FIGS. 3 and 7, when taken in conjunction with FIG. 1. As has been explained above, the modulator in FIG. 1 was double side band amplitude modulator. In a preferred embodiment, now to be explained with reference to FIGS. 3, 7 and 1, I employ a single side band modulator. Use of the single side band modulator provides a number of advantages over the double side band amplitude modulator. One advantage is that direction information may be derived from the modulator output so that we can check on not only the speed of the vehicle, but its direction as well. A second advantage is that we can provide a system in which the velocity error tolerance band is constant, regardless of the actual velocity or commanded velocity. One embodiment of the invention employing a single side band modulator will now be explained with reference to FIGS. 3 and 7.

FIG. 3 illustrates a tachometer modulator 32 which has provided to it signals from a simulator 14. In this case, two signals are provided, whose phase difference is 90°. A first signal can be defined as $A_o \cos w_c t$ and the second signal can be described as $A_o \sin w_c t$. In these signals, the frequency, that is $w_c$ is proportional to commanded velocity. Tachometer modulator 32 produces four output signals represented by $\phi_A$, $\phi_B$, $\phi_C$, and $\phi_D$. Each of these signals is provided to a summer 31 the output of which is of the form $\phi_A + \phi_B - \phi_C - \phi_D$. The structure of tachometer modulator 32 will be described with reference to FIG. 7. Those of ordinary skill in the art will understand the manner in which summer 31 is arranged to provide the output signal represented above, and there are a variety of different summers which can be employed to produce this output signal.

By reason of the single side band modulation, performed by the modulator 32, the output signals take the form of:

$$\phi_A = A_o \cos w_c t\,(K_1 \cos w_m t)$$

$$\phi_B = A_O \sin w_c t\,(K_2 \sin w_m t)$$

$$\phi_C = A_O \cos w_c t\,(-K_3 \cos w_m t)$$

$$\phi_D = A_O \sin w_c t\,(-K_4 \sin w_m t)$$

In the foregoing expressions $w_m$ is the frequency which is related to actual vehicle velocity and the constant $K_1$, $K_2$, $K_3$ and $K_4$ are the amplitudes of the modulating signals. The output of the summer 31 can then be expressed as follows:

$$A_O/2\,(K_1 + K_2 + K_3 + K_4) \cos (w_c t - w_m t)$$

$$+ A_O/2\,(K_1 - K_2 - K_3 - K_4) \cos (w_c t + w_m t).$$

If we chose the constants to be equal (i.e., $K_1 = K_2 = K_3 = K_4$), this expression can be reduced to the form of:

$$-2\,A_O K \cos (w_c t - w_m t).$$

Those of ordinary skill in the art will readily perceive that is in, in effect, the lower side band i.e., a signal that has a frequency related to the differences between $w_c$ and $w_m$. It is interesting to note that by reversing the phase relationship for the modulating components of $\phi_A$, $\phi_B$, $\phi_C$ and $\phi_D$, the resulting signal output of the summer takes the following form:

$$-2\,A_o K \sin (w_c t + w_m t).$$

Those skilled in the art will recognize the output is now the upper side band. Thus, employing a band pass filter centered at the lower side band results in direction sensitive equipment for the reason that the lower side band is produced by one direction of movement whereas the upper side band is produced by movement in the opposite direction.

To illustrate ;the manner in which this reversal takes place and the manner in which the tachometer/modulator operates reference is now made to FIG. 7. Although there are many single side band modulators which could be employed, the tachometer/modulator of FIG. 7 enjoys a number of significant advantages which are particularly related to contemporary system designs. In particular, there is a noticeable trend toward employing wheel-less vehicles and, of course, conventional tachometers could not be employed with such apparatus. FIG. 7 illustrates a tachometer, which also performs a single side band modulation function, and which at the same time does not rely upon use of a wheeled vehicle. In FIG. 7 a strip made up of components 55 and 56 is illustrated, which strip may be located on a stationary structure adjacent the path of travel of the vehicle. For instance, if the vehicle travels in a guideway the strip can be located on a vertically directed portion of the guideway. The strip itself is made up of a plurality of components of two different types, which components alternate from one type to the next within the strip. Thus, the strip component 56 has a reflection characteristic which is opposite to the reflection characteristic of strip 55. For instance, strip 56 may be reflective whereas strip 55 is non-reflective. The particular type of energy to which strip component 56 is reflective and to which strip component 55 is non-reflective depends upon the energy employed for a plurality of sensors carried on board the vehicle. The vehicle carried apparatus which sense the presence or absence of reflective strip component 56 is included within the dotted block 60. In an exemplary embodiment, shown in FIG. 7, this apparatus includes a plurality of transmitters 61, 62, 63 and 64. Also included are a plurality of sensors 65 through 68. The transmitters and sensors are designed to, respectively, transmit and receive the same type of energy. For instance, the transmitters 61–64 may comprise magnetic sources of energy whereas the sensors 65–68 may be responsive to such magnetic energy. In this embodiment strip 56 would be a "good" reflector of magnetic energy whereas strip component 55 would not. In another embodiment of the invention the transmitters 61–64 are light (visible or non-visible) transmitters and the sensors 65–68 respond to such light energy. Correspondingly, strip component 56 provides "good" reflection of such energy whereas strip component 55 does not provide "good" reflection of such energy. Other types of sensors, transmitters and strip components could also be used, many varieties of which will be obvious to those of ordinary skill in the art.

The transmitters 61–64 are driven by signals provided from the simulator 14. Particularly, two signals are available; the first signal for driving transmitters 61 and 63, and a second signal, in phase quadrature with the first signal, for driving transmitters 62 and 64. Illustratively shown in FIG. 7 are a pair of signals whose frequency is representative of the expected speed of the vehicle. Each of the sensors 65–68 produces a different output signal which can then be provided to the summer 31 (see FIG. 3) for summing in a predetermined fashion. Summer 31 can comprise an operational amplifier with appropriate inputs to provide the output represented in FIG. 3. Alternatively, a five winding transformer is employed, with four input windings, one for each of the different outputs of the tachometer/modulator 32, and the fifth winding being an output winding. The passive transformer has an advantage over the operational amplifier in that it represents a vital device whereas the amplifier, since it is an active device, may require additional apparatus to operate in a vital fashion. Of course, the sense of the winding in such a transformer would be arranged to provide the output function illustrated in FIG. 3. Furthermore, the output winding of the transformer or the operational amplifier may well be tuned such that the functions of summer and filter are performed in a single apparatus.

FIG. 6 illustrates a frequency spectrum of the output of summer 31 with respect to the pass band filter 30 in the case where filter 30 has its pass band centered at the lower side band. As is shown in FIG. 6, the carrier, at frequency $w_c$, and the upper side band, at frequency $w_c + w_m$, are shown dotted because these frequency components do not appear in the output of summer 31. Those of ordinary skill in the art will understand, however, that the pass band of filter 30 can, alternatively, be centered at the upper side band. Employing the tachometer/modulator 32 (illustrated in FIG. 7) assuming that the filter is designed to pass only the lower side band, and assuming the vehicle is travelling in the proper direction within predetermined tolerances of the speed which it expected to be travelling, filter 30 would pass energy sufficient to energize the detector 16. However, if now the vehicle reverses in direction, the upper side band will be produced from summer 31, and not the lower side band. The side band will obviously not pass filter 30, and insufficient energy will be provided to detector 16, to indicate that the vehicle is operating improperly. In order to allow reversal of vehicle direction, the signals, derived from the simulator 14, can be reversed. That is, the signal which had been coupled to transmitter 61 and 63 can now be coupled to transmitter 62 and 64, and vice versa.

Another significant advantage of employing single side band modulation is that the performance tolerance band is a simple velocity tolerance independent of actual vehicle velocity or commanded vehicle velocity. Thus, the performance band equals $\pm \Delta v$, which $\Delta v$ is a velocity difference factor. Of course, other single side band modulators could also be used in the embodiment of FIG. 3.

Figure 8A:
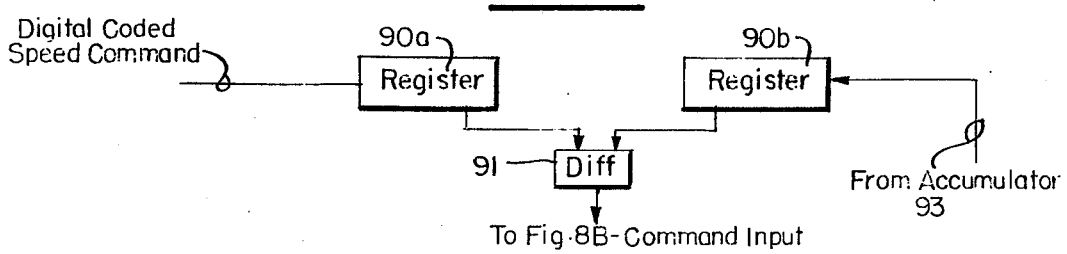
FIGS. 8A and 8b are different preferred embodiments of a function generator.
Figure 8B:
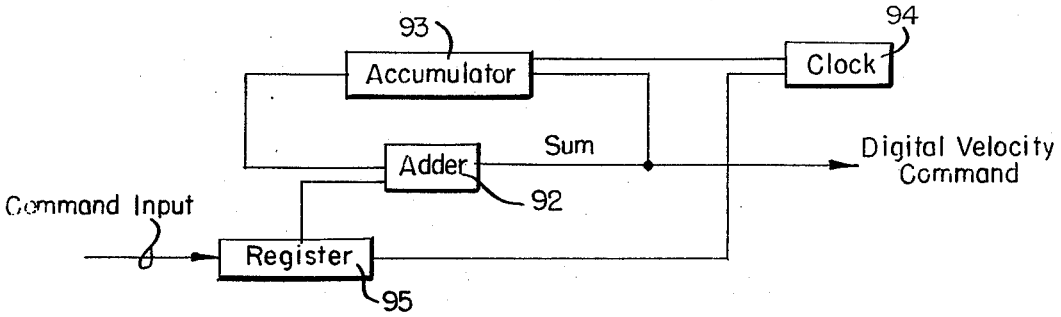

FIGS. 8A and 8B illustrate specific embodiments of the function generator. As has been mentioned above, the function generator must receive the speed command information as it is transmitted to the vehicle and, derive a voltage proportional to expected velocity, so as to drive the VCO 18.

However, as has been mentioned previously, the vehicle command need not represent velocity. The function generator of FIG. 8B is responsive to a digitally coded acceleration command. In order to simulate operation of the vehicle, assuming that a normalized vehicle reacts as a simple acceleration integrator, the function generator should have the transfer characteristic of simple integration with time constant equal to the time constant of the vehicle. Although the function generator of FIG. 8B is illustrated as being implemented with digital apparatus, those skilled in the art will understand that analog apparatus could be provided as well, assuming of course, that the command data were in analog form. Specifically, FIG. 8B illustrates that the function generator includes an adder 92, an accumulator 93 and a clock 94. The digitally coded acceleration command is provided as one input to the adder 92. The other input to adder 92 is provided by the output of an accumulator 93. The output of the adder is the digital velocity command, which is provided to the input of accumulator 93, and is also provided to the VCO 18. Of course, a D/A converter may be required to convert the adder output to a form suitable to drive the VCO 18 unless a digital VCO is employed. Clock 94 determines the rate at which the contents of the accumulator 93 are shifted out to the adder 92. In this embodiment the acceleration command clock timing is scaled to agree with the vehicle's expected performance. That is, the clock timing is arranged to simulate the required time lag to represent the vehicle's response.

The function generator of FIG. 8A is responsive to digital velocity commands rather than the acceleration commands of the apparatus of FIG. 8B. Specifically, the register 90A receives the velocity command. Register 90B contains a digital representation of actual vehicle velocity. The manner in which this information is obtained will be explained below. Subtractor 91 determines the difference between desired and actual velocity. This is an acceleration (or deceleration) factor. This is provided to register 95 (FIG. 8B). The output of the adder 92 represents expected vehicle velocity which is loaded into register 90B. The same output serves to drive the comparator, after suitable D/A and voltage to frequency conversion.

The foregoing apparatus is responsive to commands in digital form. At the present time such form is preferred as a result of its advantages with respect to undesired drift. However, analog apparatus can also be provided. Those skilled in the art will understand how such apparatus can be selected from the foregoing description.

When vehicle commands are continuous, or at a rate greater than the vehicle response time, the registers, such as 90A and 95 may be eliminated. However, where the vehicle commands are transmitted at a rate slower than the vehicle response time, the memory function performed by these registers is necessary.

Figure 9:
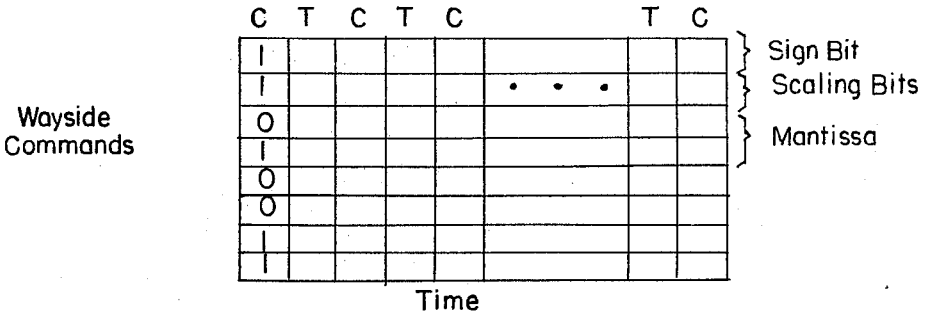
FIG. 9 illustrates the interleaving of command and test data for a dynamic checking operation.

In order to implement a simple checking scheme, the output of register 95 may "echo" its input back to the wayside for comparison purposes. Preferably, however, a dynamic check on the entire vehicle performance monitor may be implemented. In such a system the wayside transmits the vehicle command data which is stored in a register. Test data is derived from a source on the vehicle and is stored in the same register in an interleaved fashion. That is, a word of vehicle command data in the register is followed by a word of test pattern data, which is followed by a word of vehicle command data, and so on. The wayside commands are loaded into the register 95 and the contents of the register are serially outputed to the function generator. The test pattern is designed to force the output of the function generator to swing above and below normalized vehicle performance. In such an arrangement, the filter 20 (see FIG. 1) is replaced by a pair of band pass filters. One of the band pass filters is designed to detect signals above normalized vehicle performance, and the other is designed to detect energy related to vehicle performance below expected limits. For proper operation each of the band pass filters should alternately output energy at a minimum rate to ensure that the vehicle performance monitor is operating properly. Since the wayside does not transmit test data, the vehicle control system does not respond thereto. FIG. 9 illustrates, in a schematic form, the contents of the register, or its output as a function of time. The wayside serially transmits a number of multi-bit words. This command data is indicated by the reference character C, whereas the test data derived from a vehicle carried source is indicated by the reference character T. It will be seen that the test data is interleaved between the command data. Each word, both command data and test data, comprises a plurality of portions, a sign bit, a plurality of scaling bits and a further plurality of bits corresponding to the mantissa.

Figure 10A:
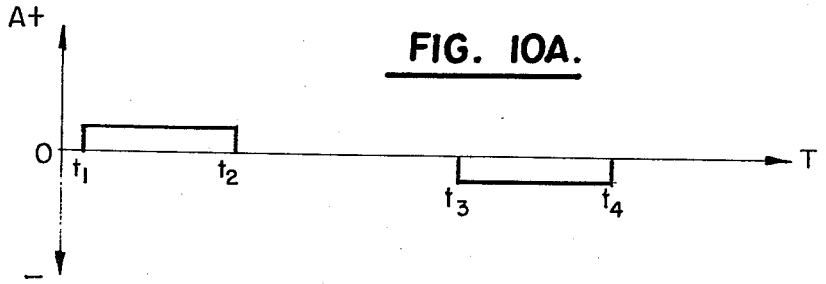
FIGS. 10A and 10B illustrate, respectively, an acceleration command signal and the corresponding output of a function generator.
Figure 10B:
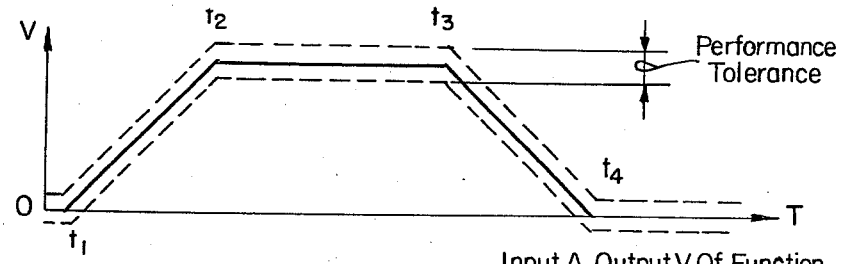
Figure 10C:
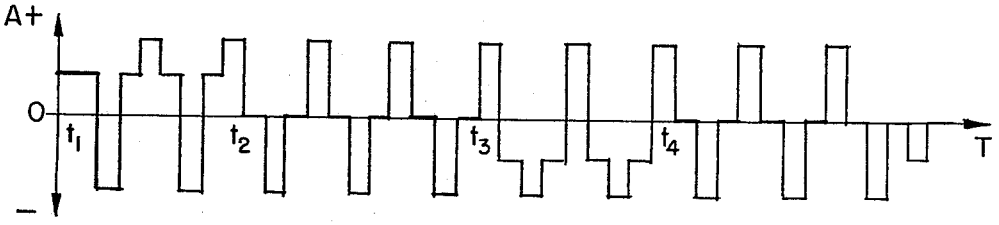
FIGS. 10C and 10D illustrate the same acceleration command interleaved with test data and the corresponding output of a function generator.
Figure 10D:
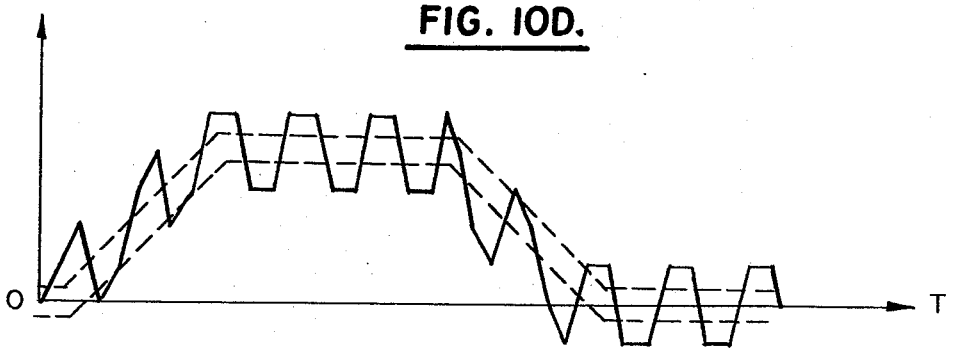

As an example, FIGS. 10A and 10B illustrate a digitally coded acceleration command input and a corresponding output of the function generator for the case in which no test function has been implemented. Correspondingly, FIG. 10C illustrates a digitally coded acceleration command input which includes a test function. For this case, FIG. 10D illustrates the output of the function generator.

Referring now to FIG. 10A, this shows, at time T1, the presence of an acceleration command. The duration of the acceleration command is proportional to the desired velocity change. The duration of the acceleration command exists from time T1 to time T2. A second acceleration command is shown extending from time T3 to T4, in the opposite sense, from the first acceleration command.

FIG. 10B illustrates the output of the function generator in response to the input. At time $T_1$, when the acceleration command commences, we have assumed that the velocity is zero. Of course, the function generator output would change from any pre-existing velocity in response to the acceleration command. Thus, the output of the function generator linearly increases from time T1 to T2, remains constant from T2 to T3, at the level obtained at time T2, and decreases linearly from time T3 to time T4. The dotted curves on FIG. 10B illustrate the performance tolerance within which the vehicle performance is expected to lie, for proper operation. This performance tolerance is established by the filter 20. (See FIG. 1).

On the other hand, FIG. 10C illustrates the amplitude and duration of various acceleration commands for a system in which the test function has been implemented. Between times T1 and T2 there is a net acceleration command equivalent to that illustrated in FIG. 11A. Between times T2 and T3, although acceleration commands exist, there is a net zero acceleration command, just as in the case of FIG. 10A. Likewise, between times T3 and T4, there is a net acceleration command equivalent to that as shown in 10A. Finally, subsequent to time T4, although a number of discrete acceleration commands exist, the net acceleration command is zero. The acceleration commands between T2 and T3 and subsequent to T4 illustrate the effect of the test data inserted into the register by the vehicle carried source.

As a result of the various acceleration commands illustrated in FIG. 10C, the output of the function generator corresponds to the solid curve illustrated in FIG. 10D. Since the vehicle's speed control system does not see the acceleration commands implemented by the test data, the speed control system will follow what corresponds to the average output of the function generator and thus will respond as the curve down in FIG. 10B. In addition, shown dotted in FIG. 10D is the performance tolerance within which the vehicle is expected to perform for proper operation. Noteworthy is the fact that the function generator output lies outside of the tolerance band. As a result, the band pass filters, mentioned above, will pass energy corresponding to the times at which the function generator output is above the upper performance tolerance or below the lower performance tolerance. This action provides the dynamic check on operation of the vehicle performance monitor.

Figure 11:
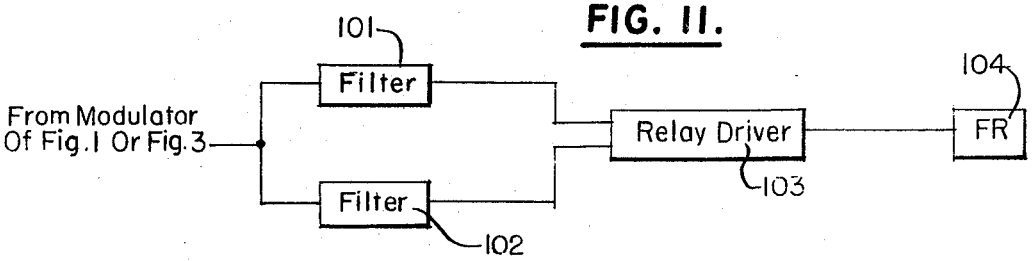
FIG. 11 is a block diagram of still another embodiment of the invention utilized with a dynamic check.

FIG. 11 illustrates the modification necessary to the comparator 15, and detector 16 (of FIG. 1) to implement the dynamic checking operation described above. In particular, the output of the modulator, which can be either modulator of FIG. 1 or the modulator of FIG. 3, is provided to a pair of filters, a filter 101 and a filter 102. The output of each of these filters is provided to a relay driver 103, whose output in turn is provided to a failure relay 104. Filter 101 may be a low pass filter, whereas filter 102 may comprise a high pass filter. Due to the dynamic test operation, when the test data drives the function generator output below the lower performance tolerance limit, filter 101 will pass significant amounts of energy. Correspondingly, when another test word drives the output of the function generator above the upper performance limit, the output of filter 102, the high pass filter, will pass significant amounts of energy. Relay driver 103 detects the alternating outputs from filters 101 and 102, and when such proper energy outputs are obtained, it maintains failure relay 104 in its energized state. Thus, for instance, the outputs of filters 101 and 102 may drive a flipflop, one of whose outputs may be connected to drive relay driver 17 as is illustrated in the Butler et al U.S. Pat. No. 3,886,420. So long as the output of such a flipflop changes state at the proper rate, the relay 104 will remain energized. If, however, the alternating output is not obtained, or if it is obtained at an incorrect rate, the relay 104 will become de-energized to indicate a failure of the apparatus.

To assist in an understanding in the manner in which the function generator characteristics are related to that of the vehicle which it simulates, the following example is presented.

Figure 12:
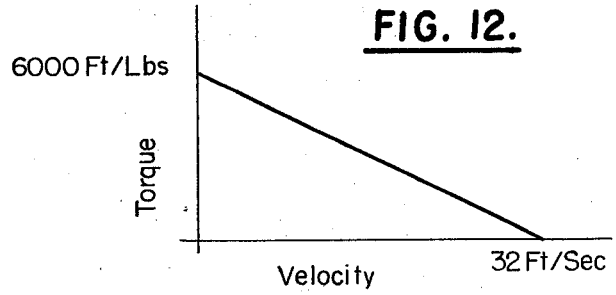
FIGS. 12–14 illustrate implementation of a simulator.

Assume a vehicle, employing series propulsion motors, has an axle torque vs. vehicle speed curve such as that shown in FIG. 12. We can further assume that the vehicle has the following additional parameters:

vehicle weight: 32,000 lbs.
wheel radius: 1.50 ft.
acceleration maximum: 4 ft./Sec.$^2$
motor time constant: 128 ms.

We also assume that the onboard speed regulator algorithm (see FIG. 1) is simple conversion from an input to an analog output corresponding to an acceleration command which is provided to the motor. The necessary fuction generator transfer characteristic will then be of the form of the block diagram illustrated in FIG. 13 wherein the acceleration command input is one input to a summer 125, whose output is provided as an input to a non-linear element 126 having the characteristic illustrated in the block. The output of element 126 is provided as an input to element 127 whose transfer function is reproduced in block 127 in Laplace transform notation, the output of block 127 is provided as input for block 128, which is an integrator having the Laplace transfer characteristic shown in block 128. The output of block 128 is a signal corresponding to the expected velocity of the vehicle in response to the acceleration command. That output is also provided as an input to feedback elements 129, which has a proportional transfer characteristic, the proportionality constant being $\frac{1}{8}$. Finally, the output of feedback element 129 is provided as a second input to the summer 125, with the indicated polarity.

The non-linear characteristic of block 126 allows only positive acceleration commands to be operated on. The characteristic of block 127 corresponds to the motor response transfer function and therefore produces, as an output, a signal proportional to expected acceleration in response to any particular positive acceleration input command. The integrator of block 128 produces an output signal which is related to expected velocity. By reason of the feedback network 129 the overall characteristic of the simulator figure of FIG. 13 is to simulate the characteristic illustrated in FIG. 12.

Figure 13:
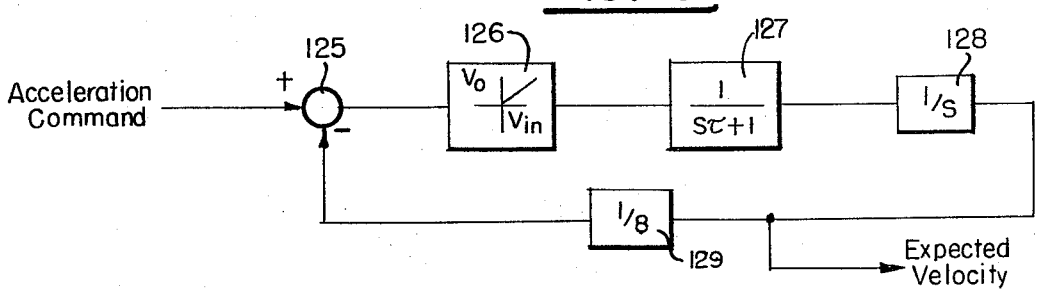
Figure 14:
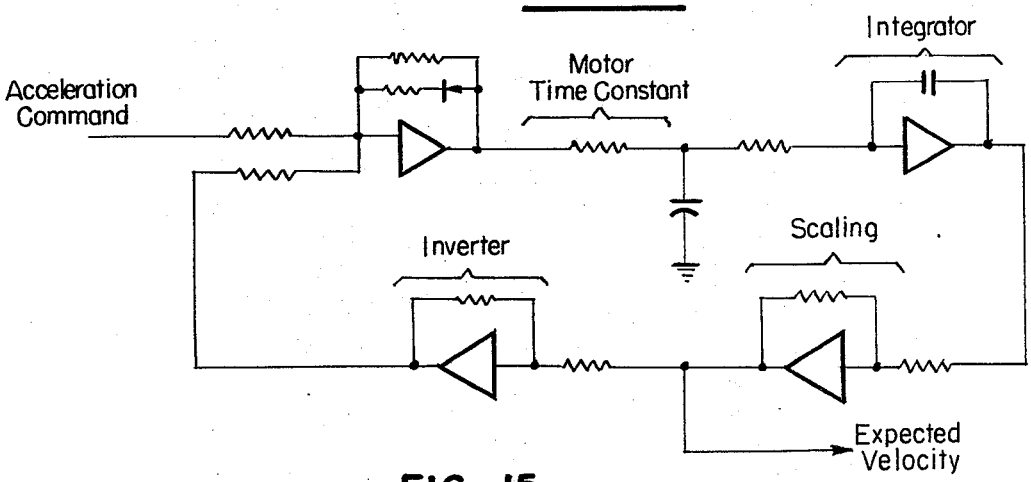

FIG. 14 is an illustration of an actual analog implementation of the function generator which is functionally illustrated in FIG. 13. Inasmuch as it is believed that those skilled in the art will readily perceive the correspondence between FIGS. 13 and 14, no further discussion is deemed necessary.

Figure 15:
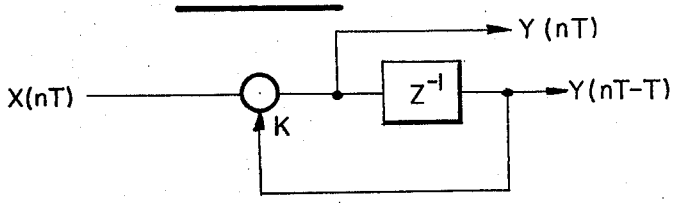
FIG. 15 illustrates a digitally implemented integrator.

While the implementation of FIG. 14 is analog in form, that is not a necessity for my invention. FIG. 15 illustrates a digital implementation of an integrator, employing the Z transform in place of the linear Laplace transform. In the drawing of FIG. 15, K is a scaling constant which is equivalent to a time constant in the time domain. The non-linear element may be implemented with a digital comparator. Time between computations, T, must be chosen such that the quantization effects would be minimized. With the given parameters, a 1 millisecond computation time is reasonable; since the shortest time constant is 128 ms.

I claim:

1. A vehicle performance monitor for detecting vehicle performance within a predetermined band of desired vehicle performance by comparing a signal indicative of vehicle performance with a signal generated in response to vehicle control signals communicated to said vehicle and representative of desired vehicle performance, said apparatus comprising, simulator means responsive to said control signals to generate an output signal representative of an expected value of said signal indicative of vehicle performance, and comparator means responsive to the output of said simulator means and to said signal indicative of vehicle performance for indicating whether vehicle performance is within a predetermined range of expected vehicle performance.

2. The apparatus of claim 1 wherein said simulator means includes function generator means responsive to said control signals and a voltage controlled oscillator, responsive to the output of said function generator means for producing an output frequency representative of an expected value of said signal indicative of vehicle performance.

3. The apparatus of claim 1 wherein said comparator means comprises a modulator responsive to the output of said simulator means and to said signal indicative of vehicle performance.

4. The apparatus of claim 3 in which said comparator means further includes filter means coupled to the output of said modulator means.

5. The apparatus of claim 4 wherein said filter means includes a band pass filter.

6. The apparatus of claim 4 in which said modulator means includes a double side band amplitude modulator.

7. The apparatus of claim 4 in which modulator means includes a single side band modulator.

8. The apparatus of claim 7 in which said simulator means produces a pair of outputs, a one of said outputs shifted in phase with respect to another of said outputs, said single side band modulator being a suppressed carrier modulator producing only a single side band at a frequency determined by the frequency of the output of said simulator means and the frequency of said signal indicative of vehicle performance.

9. The apparatus of claim 8 in which said modulator produces only the lower side band.

10. The apparatus of claim 8 in which said modulator produces only the upper side band.

11. The apparatus of claim 2 wherein said signal indicative of vehicle performance is proportional to vehicle velocity and said control signal is definitive of vehicle acceleration and in which said function generator means includes an integrator.

12. The apparatus of claim 11 in which said integrator comprises a digital integrator.

13. A vital vehicle performance monitor for detecting vehicle performance within a predetermined band by comparing a signal indicative of vehicle performance with a signal generated in response to vehicle control signals communicated to said vehicle and for dynamically checking the operation of said monitor wherein said control signals are interleaved with test signals, said apparatus comprising, means for deriving a first signal indicative of actual vehicle performance, function generator means responsive to said control signals and said test signals for producing a second signal representative of simulated vehicle performance in response to said control signals and test signals, oscillator means responsive to said second signal for generating a third signal with frequency proportional to said second signal, modulator means responsive to said first and third signals for producing a fourth signal with frequency related to the combination of said first and third signals, a pair of filters coupled to the output of said modulator means, and detector means coupled to said filters for determining proper operation by the alternate output of said filters.

14. The apparatus of claim 13 wherein said modulator comprises a single side band suppressed carrier modulator.

15. The apparatus of claim 14 in which said modulator produces a fourth signal whose frequency is the difference between the frequency of said first and third signals.

16. The apparatus of claim 14 wherein said modulator produces a fourth signal whose frequency is related to the sum of the frequencies of said first and third signals.

17. The apparatus of claim 13 wherein one of said filters is a low pass filter and said other filter is a high pass filter.

* * * * *